US012078049B2

(12) United States Patent
Mörtzell et al.

(10) Patent No.: US 12,078,049 B2
(45) Date of Patent: Sep. 3, 2024

(54) ARRANGEMENT OF CONTROLLING DRILLING PARAMETERS DURING EXTRACTION OF A DRILL STRING

(71) Applicant: EPIROC ROCK DRILLS AKTIEBOLAG, Örebro (SE)

(72) Inventors: Gustav Mörtzell, Örebro (SE); Magnus Olsson, Hallsberg (SE)

(73) Assignee: EPIROC ROCK DRILLS AKTIEBOLAG, Örebro (SE)

( * ) Notice: Subject to any disclaimer, the term of this patent is extended or adjusted under 35 U.S.C. 154(b) by 0 days.

(21) Appl. No.: 18/253,098

(22) PCT Filed: Nov. 1, 2021

(86) PCT No.: PCT/SE2021/051089
§ 371 (c)(1),
(2) Date: May 16, 2023

(87) PCT Pub. No.: WO2022/115016
PCT Pub. Date: Jun. 2, 2022

(65) Prior Publication Data

US 2024/0011387 A1 Jan. 11, 2024

(30) Foreign Application Priority Data

Nov. 27, 2020 (SE) ..... 2051380-0

(51) Int. Cl.
*E21B 44/02* (2006.01)
*E21B 7/02* (2006.01)
(Continued)

(52) U.S. Cl.
CPC ..... *E21B 44/02* (2013.01); *E21B 7/025* (2013.01); *E21B 44/04* (2013.01); *E21B 44/06* (2013.01)

(58) Field of Classification Search
CPC . E21B 44/02; E21B 3/02; E21B 7/025; E21B 19/08; E21B 44/06; E21B 44/04
See application file for complete search history.

(56) References Cited

U.S. PATENT DOCUMENTS 4,074,771 A 2/1978 Morrison
2007/0007039 A1 1/2007 Noel
(Continued)

FOREIGN PATENT DOCUMENTS

WO 2006032733 A1 3/2006
WO 2008115113 A1 9/2008
(Continued)

OTHER PUBLICATIONS

International Search Report and Written Opinion mailed Jan. 18, 2022 for International Application No. PCT/SE2021/051089, 9 pages.

*Primary Examiner* — Brad Harcourt
(74) *Attorney, Agent, or Firm* — Sage Patent Group

(57) ABSTRACT

The invention relates to an arrangement for controlling a rock drilling machine during an extraction of a drill string from a drilled bore, the rock drilling machine being movably arranged on a feeder, the arrangement comprising an actuator arranged to move the rock drilling machine in a direction opposed to a drilling direction along the feeder, a rotation motor arranged to rotate the drill string, and an actuator controller arranged to control the actuator during the extraction of the drill string from a drilled bore, the actuator controller being arranged to control the actuator according to a first or a second mode in dependence of an operational parameter, such as a torque generated by the rotation motor to rotate the drill string.

11 Claims, 4 Drawing Sheets

(51) Int. Cl.
*E21B 44/04* (2006.01)
*E21B 44/06* (2006.01)

(56) References Cited

U.S. PATENT DOCUMENTS

| | | | | |
|---|---|---|---|---|
| 2009/0205868 | A1* | 8/2009 | Lane | E21B 44/00 175/24 |
| 2011/0108324 | A1 | 5/2011 | Stacy, II et al. | |
| 2018/0297126 | A1 | 10/2018 | Drexl et al. | |
| 2020/0392798 | A1* | 12/2020 | Cutler | E21B 3/02 |

FOREIGN PATENT DOCUMENTS

| | | | |
|---|---|---|---|
| WO | 2009123535 | A1 | 10/2009 |
| WO | 2012102966 | A2 | 8/2012 |

* cited by examiner

ARRANGEMENT OF CONTROLLING DRILLING PARAMETERS DURING EXTRACTION OF A DRILL STRING

CROSS-REFERENCE TO RELATED APPLICATIONS

This application is a 35 U.S.C. § 371 national stage application for International Application No. PCT/SE2021/051089, entitled "ARRANGEMENT OF CONTROLLING DRILLING PARAMETERS DURING EXTRACTION OF A DRILL STRING", filed on Nov. 1, 2021, which claims priority to Swedish Patent Application No. 2051380-0, filed on Nov. 27, 2020, the disclosures and contents of which are hereby incorporated by reference in their entireties.

TECHNICAL FIELD

The invention relates to an arrangement of controlling operational drilling parameters during extraction of a drill string from a drilled bore. The invention also relates to a drill rig comprising such an arrangement.

BACKGROUND

In the technical field of rock drilling, different drilling parameters, such as rotational speed of the drill string, feed force acting on the drilling machine percussion force and the like are continuously monitored and controlled throughout a drilling operation.

After a concluded drilling operation, the string is retrieved from the bore hole, rod by rod, preferably in a manner that is the least time consuming possible. This may be achieved by pulling the drill string backwards at a constant and relatively high moving speed while providing a continuous rotation to the drill string.

A problem that may arise is that the drill string may get stuck somewhere inside the bore during the extraction of the drill string. Often, this means that the drill string will need to be re-advanced until it is once again possible to extract the drill string by recommencing the backward feeding or pulling of the drill string. This is troublesome both because it is time consuming and because it may inflict unwanted tensions in the drill string and/or other parts of the drilling equipment. The drill string is typically very strong in its axial direction, i.e. in the drilling direction, but not equally strong in the orthogonal direction, such that forces that may arise in that direction in the occurrence of deadlock may harm parts of the drill string.

It would be advantageous to achieve an arrangement and a method overcoming, or at least alleviating, at least one or some of the drawbacks of the prior art. In particular, it would be advantageous to find an arrangement and a method that minimises downtime due to unwanted deadlocks.

SUMMARY OF THE INVENTION

It is an object of the invention to provide an arrangement and a method of retrieving a drill string from bore in a manner that is effective and that decreases the risk of problems leading to downtime and/or material damages. This object is achieved by means of the invention according to a first and a second aspect.

According to a first aspect the invention relates to an arrangement for controlling a rock drilling machine during an extraction of a drill string from a drilled bore, the rock drilling machine being movably arranged on a feeder, the arrangement comprising:

an actuator arranged to move the rock drilling machine in a direction opposed to a drilling direction along the feeder, a rotation motor arranged to rotate the drill string, and an actuator controller arranged to control the actuator during the extraction of the drill string from a drilled bore, the actuator controller being arranged to control the actuator according to a first or a second mode in dependence of at least one operational parameter from a set of parameters including: a representation of a torque generated by the rotation motor to rotate the drill string, a representation of a rotation speed of the drill string provided by the rotation motor, a representation of a force provided by the actuator to move the rock drilling machine in the direction opposed to the drilling direction, and a representation of a moving speed of the rock drilling machine provided by the actuator, wherein the actuator controller, in the first mode, is arranged to control a moving speed at which the actuator moves the rock drilling machine in the direction opposed to the drilling direction, and wherein the actuator controller, in the second mode, is arranged to control a force provided by the actuator to move the rock drilling machine in the direction opposed to the drilling direction.

An advantage of the arrangement is that it is adaptable between a first and a second mode, wherein the first mode should be used when circumstances allow it for a rapid extraction of a drill string from a drill bore. When, on the other hand, precaution is deemed necessary based on a given operational parameter, the actuator may operate in the more fail-safe, second mode. Thereby an overall rapid and reliable operation is provided, without jeopardizing the function of the drilling equipment.

According to embodiments of the invention the actuator controller is configured to switch control of the actuator from the first mode to the second mode in response to that at least one operational parameter from the set of parameters exceeds or falls below a first threshold.

This is an advantageous manner of initializing operation in accordance with the second mode when this is called for.

According to embodiments of the invention the actuator controller is configured to switch control of the actuator from the first mode to the second mode when the representation of torque generated by the rotation motor exceeds a first torque threshold.

The torque generated by the rotation motor may advantageously be used as a trigger to control the actuator between the different modes during the extraction of the drill string and to offer a manner of automatising the extraction operation.

According to embodiments of the invention the actuator controller is configured to switch control of the actuator from the first mode to the second mode in response to that the representation of the torque generated by the rotation motor increases with a rate, e.g. derivative coefficient, that exceeds a first threshold rate, e.g. a first derivative coefficient.

According to embodiments of the invention a rotation controller is arranged control the rotation motor of the drilling machine to maintain the rotation speed at or above a first rotation speed in the second mode.

This is advantageous because the rotation will prevent jamming of the drill string.

According to embodiments of the invention the rock drilling machine is a hydraulic rock drilling machine and wherein the representation of the torque generated by the rotation motor is determined from a representation of a rotation pressure of a hydraulic fluid delivered to the rotation motor to drive the rotation thereof.

According to embodiments of the invention the actuator controller, in the first mode, is arranged to control the actuator to a moving speed corresponding to a first moving speed.

A constant speed is advantageous as it may allow a rapid extraction operation of the drill string.

According to embodiments of the invention the actuator controller, in a restart of the extraction operation after a confirmed jamming of the drill string, is arranged to control the actuator to a moving speed corresponding to a second moving speed, which is lower than the first moving speed.

This is advantageous because it reduces the risk of operation failure in a sensitive re-start of the extraction operation.

According to embodiments of the invention the actuator controller is arranged to switch control of the actuator from the second mode to the first mode when the representation of the torque provided by the rotation motor to generate a rotation speed of the drill string corresponding to a first rotation speed reaches below a second torque threshold.

This is advantageous because it offers a reliable manner for the actuator controller of returning to the more rapid first mode from when operating in the second mode.

According to embodiments of the invention the actuator comprises a hydraulic motor and wherein the actuator controller is a control device configured to control the provision of hydraulic fluid to the actuator and wherein the actuator controller in the first mode controls a flow of hydraulic fluid delivered to the actuator, and in the second mode controls a pressure of the hydraulic fluid delivered to the actuator.

This is an advantageous manner of controlling a hydraulic motor in either of two different modes depending on reigning circumstances.

According to a second aspect the invention relates to a drill rig comprising a rock drilling machine and an arrangement as defined above for controlling the moving of the rock drilling machine during an extraction of the drill string connected the rock drilling machine from a drilled bore hole.

Other embodiments of the invention according to the three aspects and advantages thereof will be apparent from the detailed description and the appended drawings.

BRIEF DESCRIPTION OF THE DRAWINGS

Below, specific embodiments of the invention will be described with reference to the appended drawings, of which.

DETAILED DESCRIPTION OF THE SHOWN EMBODIMENTS

Figure 1:
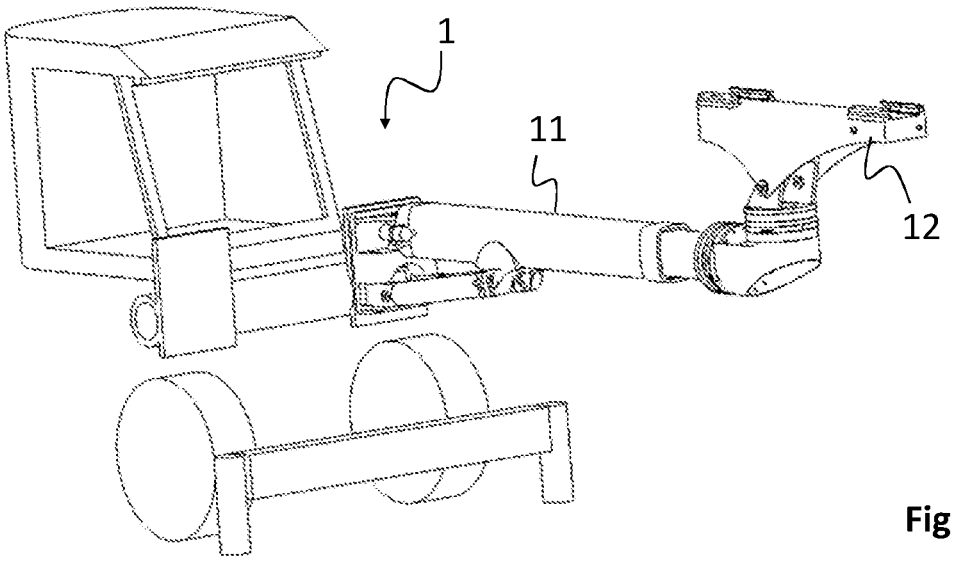
FIG. 1 is a very schematic view of part of a drill rig according to an aspect of the invention.

In FIG. 1 a drill rig 1 is schematically shown. The drill rig 1 comprises a feeder holder 12 arranged at an outer end of an extensible boom 11. The feeder holder 12 is arranged to carry a feeder, which is preferably arranged in a movable manner with respect to the feeder holder 12.

The shown drill rig 1 is only an example of a drill rig on which the inventive arrangement may be used. The inventive arrangement may be used in a wide variety of applications including down the hole-drilling, and in the hole-drilling in which a percussion unit is arranged at the outer end of the drill string, inside the bore hole during drilling a drilling operation. The rotation unit is preferably arranged on a feeder outside the bore hole. The drill rig 1 may also comprise a rock drilling machine arranged on a feeder.

Figure 2:
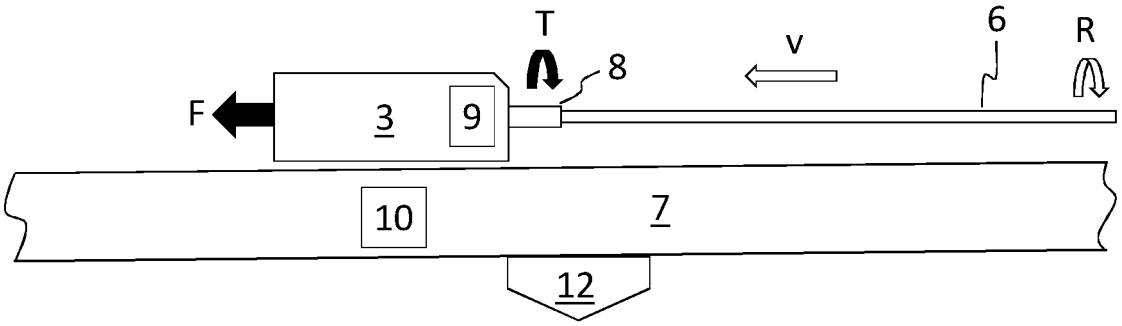
FIG. 2 is a schematic view of a feeder with an arrangement according to an aspect of the invention.

In FIG. 2 a feeder 7 of a drill rig is schematically shown. The feeder 7 is arranged on a feeder holder 12, which is preferably arranged at an outer end of a boom, such as the extensible boom 11 shown in FIG. 1. Often, a feeder 7 is displaceable in its axial direction with respect to the feeder holder 12, and the feeder holder 12 is preferably tiltable with respect to the boom 11. A rock drilling machine 3 is movably arranged on the feeder 7, such that it is movable back and forth along the length of the elongate feeder 7.

The rock drilling machine 3 comprises a rotation motor 9 arranged to provide a rotation speed R via a drill string holder 8 to a drill string 6, configured to bore a hole into e.g. a rock. Depending on the application and the type of drill rig, the rock drilling machine 3 may include both a rotation motor 9 and a percussion unit, but in some applications the percussion unit is arranged at the outer end of the drill string such that the rock drilling machine 3 may be said to be comprised of a rotation motor 9. In this application the term rock drilling machine 3 is used in a wide meaning so as to cover any drilling machine that is movably arranged and includes any type of rotation motor arranged to drive a drill string into a rock or the like.

An actuator 10 is arranged at the feeder 7 to move the drilling machine 3 in a direction opposed to the drilling direction so as to retrieve the drill string 6 from inside a drilled bore.

Specifically, the actuator 10 may be comprised of an arrangement arranged to move the rock drilling machine 3 both back and forth along the elongate feeder 7 and may include one or more hydraulic motors, specifically hydraulic cylinders. Such an arrangement may be stronger in a forward, drilling direction, as more power is needed to push the drill string into a rock than to extract the drill string 6 from the drilled bore. However, the opposite may also be true in view of that the rock drilling machine 3 drives the forward movement, the actuator 10 may also be arranged to be stronger in the direction opposed to the drilling direction. The actuator 10 may also in specific embodiments be a separate actuator arranged to move the drilling machine 3 only in a direction opposed to the drilling direction to retrieve the drill string 6 from the drilled bore.

Figure 3:
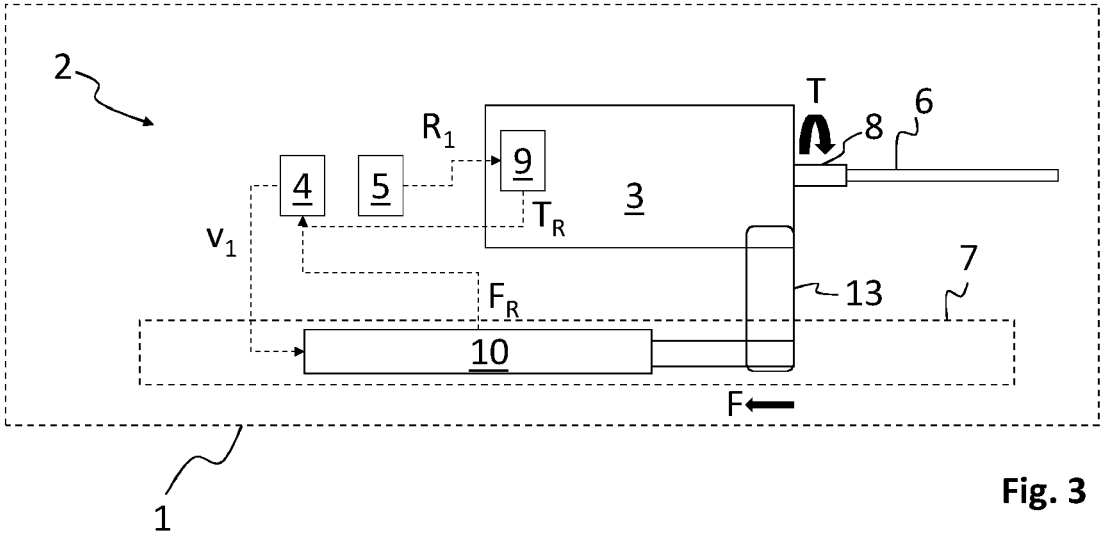
FIG. 3 is a schematic view of an arrangement according to an aspect of the invention.

In FIG. 3 an arrangement 2 for controlling the operation of a rock drilling machine 3 during an extraction of the drill string 6 from a drilled bore is schematically illustrated. A drill rig 1, comprising the arrangement is illustrated as a box enclosing the whole arrangement 2.

The arrangement 2 comprises an actuator controller 4 arranged to control the actuator 10. Conventionally, the actuator 10 is set to extract the drill string 6 from the drill bore at a constant moving speed. In the inventive arrangement the actuator controller 4 is arranged to control the actuator 10 in accordance with a first or a second mode in dependence of at least one operational parameter. The operational parameter is preferably one of the following parameters: a representation of a torque Tq generated by the rotation motor 9; a representation of a rotation speed R of the drill string 6 provided by the rotation motor 9; a representation of a force F provided by the actuator 10 to move the rock drilling machine 3; and a moving speed v of the rock drilling machine 3 provided by the actuator 10 in the direction opposed to the drilling direction.

In the first mode the actuator controller 4 is arranged to control a moving speed v at which the actuator 10 moves the rock drilling machine 3 in the direction opposed to the drilling direction, and in the second mode the actuator controller 4 is instead arranged to control a force F provided by the actuator 10 to move the rock drilling machine 3 in the direction opposed to the drilling direction.

Under normal conditions it is preferred to control the actuator 10 in accordance with the first mode, i.e. to control the moving speed v at which the actuator 10 moves the rock drilling machine 3 in the direction opposed to the drilling direction. Namely, in the first mode the operation of extracting the drill string 6 may normally be performed relatively quick. The second mode is intended to be used when the operation of extracting the drill string 6 risk to encounter problems, i.e. through narrow passages with accumulated rocks which may hinder a bore crown at the outer end of the drill string 6 and cause the extraction operation of the drill string 6 to stop.

An aspect that may need attention in the choice between the first and the second mode is to foresee when it may be useful to switch from one mode to the other. For instance, obstacles or blocks may build up over time or occur instantly, such that a need to switch from the first mode to the second mode may arise slowly or instantly. Therefore, the invention comprises a step of monitoring at least one operational parameter, such that the actuator controller 4 may control the actuator 10 in dependence of said operational parameter. The operational parameter may be chosen from a set of parameters that include a representation of a torque Tq generated by the rotation motor 9, a representation of a rotation speed R of the drill string provided by the rotation motor 9, a representation of a force F provided by the actuator 10 to move the rock drilling machine 3, or a representation of a moving speed v of the rock drilling machine 3 provided by the actuator 10. The actuator controller 4 may also control the actuator 10 in dependence of more than one operational parameter, where each parameter may be compared to individual thresholds, and/or in specific combinations of parameters where at least two parameters combine to a common value that may be compared to a common threshold.

In the first mode the actuator controller 4 is arranged to control the moving speed v at which the actuator 10 moves the rock drilling machine 3 is arranged to a first moving speed $v_1$ by providing a variable force F depending on the resistance encountered by the actuator 10. If the resistance increases an increased force F will need to be provided by the actuator 10 to keep the moving speed v at the first moving speed $v_1$.

In the second mode the actuator controller 4 is instead arranged to control the force F provided by the actuator 10 to move the rock drilling machine 3. Thereby, the moving speed v at which the actuator 10 moves the rock drilling machine 3 will vary depending on the resistance encountered by the actuator 10 to move the rock drilling machine 3. Generally, the moving speed v at which the actuator 10 moves the rock drilling machine 3 will be lower in the second mode, and the moving speed v will be inversely proportional to the resistance encountered by the actuator 10 to move the rock drilling machine 3. However, in the second mode, the moving speed v may also increase uncontrollably if the drill string 6 may be extracted without encountering any significant resistance.

The arrangement may also comprise a rotation drive controller 5 arranged to control a rotation speed R provided by a rotation motor 9 of the rock drilling machine 3 to the drill string 6. If no problems arise the rotation speed R is controlled to a first rotation speed $R_1$ by providing a variable torque Tq depending on the resistance encountered by the drill string, which needs to be overcome by the power of the rotation motor 9 to keep the rotation speed R at the first rotation speed $R_1$ In FIG. 3 it is illustrated that the actuator controller 4 may receive feedback from both the rotation motor 9 of the rock drilling machine 3 and from the actuator 10. The feedback may include a representation of a force F provided by the actuator 10 and a representation of a torque Tq provided by the rotation motor 9. The feedback may also include representation of a rotation speed R of the drill string provided by the rotation motor 9, a representation of a moving speed v of the rock drilling machine 3 provided by the actuator 10. Sensors may be arranged to monitor the rotation speed R of the drill string and the moving speed v of the rock drilling machine 3.

The representations of the force F and the torque Tq may be the direct force and torque provided by the actuator 10 and the rotation motor 9, respectively. For a hydraulic actuator 10 and a hydraulic rotation motor 9 the representations may be provided from the pressure of the hydraulic fluid provided to the actuator 10 and the rotation motor 9, respectively. In the shown embodiment the actuator 10 is illustrated as a hydraulic cylinder of which the movable piston is connected via a connector 13 to the rock drilling machine 3, to move the rock drilling machine 3.

For electric motors, the representations may be based on a delivered current to drive the actuator 10 and the rotation motor 9, respectively.

In accordance with the invention the actuator controller 4 may act on the received feedback in the form of a representation of a force F and a representation of a torque Tq to keep the moving speed v at a desired first moving speed $v_1$.

Below and in the drawings the representations of the different parameters, i.e. the torque Tq, the force F, the rotation speed R, and the moving speed v are assumed to correspond to the actual values of these parameters. It should however be noted that the actuator controller 4 will control the actuator 10 in dependence of a representation of the relevant parameter, which representation could be achieved in many ways but which should correspond as closely as possible to the actual value of the relevant parameter.

In the second mode the actuator controller 4 is arranged to allow the moving speed v of the rock drilling machine 3 to pass below the first moving speed $v_1$ by instead providing a limited force F to the actuator 10. The actuator controller 4 may be arranged to switch the driving of the actuator 10 from the first mode to the second mode in response to an increase of the representation of the torque Tq to above a first torque threshold $Tq_1$. In response thereof, the moving speed v of the rock drilling machine 3 may be allowed to pass below the first moving speed $v_1$ by limiting the force F provided by the actuator 10.

Figure 4:
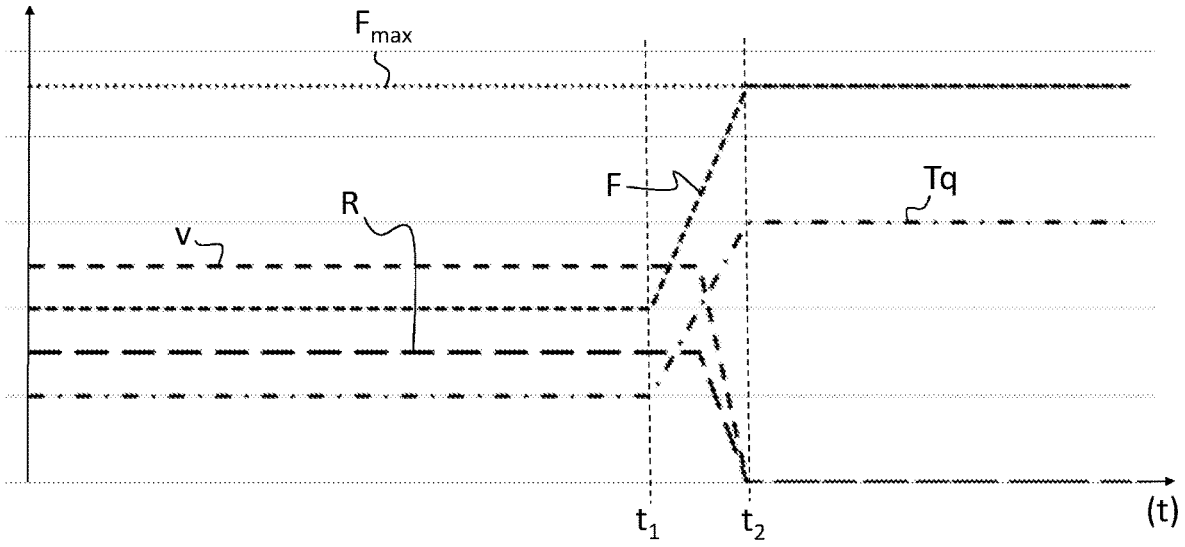
Fig. 4 (PRIOR ART)
FIG. 4 is a schematic diagram of the progress of a prior art arrangement over time.

In FIG. 4, a typical prior art situation is shown, where different operational parameters are shown as functions of operational time t. The different operational parameters are: The moving speed v at which the actuator 10 moves the rock drilling machine 3, the force F provided by the actuator 10 to move the rock drilling machine 3, the torque Tq generated by the rotation motor 9, and the rotation speed R of the drill string provided by the rotation motor 9.

In the first part of the representation there are no obstacles and the drill string may be moved backwards, i.e. opposite the drilling direction, at a constant moving speed v which may correspond to a desired and pre-set first moving speed. Also, the rotation speed R may be kept at a constant rotation speed corresponding to a first desired and pre-set rotation speed. At time $t_1$ the drill string encounters an obstacle that hinders the moving and the rotation of the drill string.

In the represented conventional arrangement, when the drill string encounters an obstacle that hinders the moving and the rotation of the drill string, both the feed force F, e.g. the feed pressure for a hydraulic drive, and the torque Tq, e.g. the rotation pressure for a hydraulic rock drilling machine, will be increased in an attempt to keep the moving speed v at a desired first moving speed and the rotation speed R at a desired first rotation speed. This may be successful for smaller obstacles like a small rock being trapped between the drill string and the inside of the bore. However, in the represented typical scenario it leads to an operational breakdown where the drill string will get stuck after a sudden decrease of both the rotation speed R and the moving speed v, until time $t_2$ where the both the rotation speed R and the moving speed v are at zero, despite that the both the feed force F and the torque Tq are at their respective pre-set maximal values.

This type of operational breakdowns may conventionally be addressed by reversing the moving direction of the drill string, i.e. by pushing the drill string back into the bore with the actuator 10 while the drill string 6 is rotated by the rotation motor 9. This may or may not be successful. There is always a risk that the drill string will be immediately jammed or stuck upon restart of the extraction of the drill string 6. In all events the operational breakdown will complicate the operation and produce unwanted losses of time, and the operational breakdown may produce unwanted tensions on the drill string that may harm the rock drilling machine 3 and/or the drill rods of the drill string 6.

According to embodiments of the invention, jamming of the drill string 6 may be avoided to a great extent. Also, if the drill string is jammed, the operation may be restarted in a more fail-safe mode, which to a certain extent may be viewed as an anti-jamming mode in which the risk of jamming of the drill string is minimised.

Figure 5:
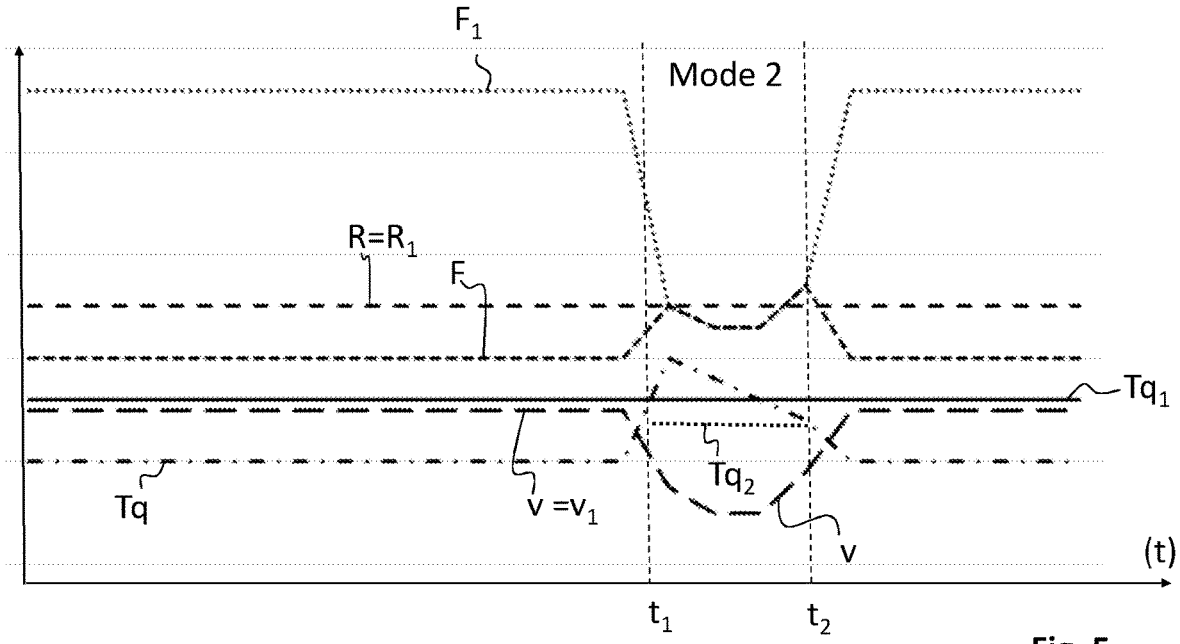
FIG. 5 is a schematic diagram of the progress of an arrangement according to an aspect of the invention over time.

In FIG. 5, an operation of extracting a drill string which is controlled according to embodiments of the invention is shown in a very schematic manner. When there are no obstacles the operation may be operated in accordance with the first mode, but a difference with respect to the prior art may be noted as soon as an obstacle has been noted at time $t_1$. In the shown embodiment the torque Tq functions as trigger for the actuator controller 4 to control the actuator 10 in accordance with a second mode. In operation, the torque Tq is estimated from a representation of the torque Tq, which for a hydraulic drilling machine may be estimated from a rotation pressure provided by a rotation motor in the drilling machine. As the representation of the torque Tq exceeds a first torque threshold $Tq_1$ the actuator controller 4 is triggered to control the actuator 10 in accordance with the second mode.

As an alternative, the actuator controller 4 may be configured to control the actuator 10 from the first mode to the second mode in response to that torque Tq generated by the rotation motor 9 increases at a rate that exceeds a pre-set first rate. In other words, a derivative coefficient DTq/dt of the torque Tq generated by the rotation motor 9 exceeds a pre-set first derivative coefficient $DTq/dt_1$. In FIG. 5, such a pre-set first rate, e.g. in the form of a derivative coefficient $DTq/dt_1$ could be exceeded in the portion illustrated between time $t_1$ and time $t_2$, where the torque Tq increases at a high rate such that increase of the torque Tq is elevated and exceeds a pre-set first rate.

In the period following time $t_1$, instead of increasing the force F and the torque Tq to pre-set maximum levels as in the prior art, the extraction of the drill string will be operated according to the second mode, wherein the force F is controlled and the moving speed v will be allowed to decrease below the first moving speed $v_1$.

In the second mode, the actuator controller 4 may control the actuator 10 by regulating the force F provided by the actuator 10 to move the rock drilling machine 3. Specifically, the actuator controller 4 may control the movement of the rock drilling machine 3 by regulating a first force threshold $F_1$, which the force F shall not exceed. For example, the actuator controller 4 may control movement of the rock drilling machine 3 by lowering the first force threshold $F_1$ in response to that the representation of the torque Tq exceeds above the first torque threshold $Tq_1$. In the subsequent phases of the operation according to the second mode the force F is controlled in response to the representation of the torque Tq, where an increase of the representation of the torque Tq may imply a lowering of the force F. In specific embodiments the force F is maintained a low constant level as long as the actuator controller 4 controls the actuator 10 in accordance with the second mode.

In the shown embodiment the obstacle causing the increased force F and/or the increased torque Tq will not result in an operational breakdown. Instead, the obstacle may be neutralised such that the operation may return to normal. The neutralisation is preferably achieved by keeping up the rotation speed R at a constant first rotation speed $R_1$, which in turn is achieved by increasing the torque Tq provided by the rotation motor 9, while the force F provided by the actuator 10 is limited such that the moving speed v of the rock drilling machine 3 will be allowed to decrease.

Specifically, the arrangement 2 includes a rotation drive controller 5 arranged to control the rotation speed R provided by the rotation motor 9 of the rock drilling machine 3 to the drill string 6. The rotation drive controller 5 may be arranged to maintain the rotation speed R at or above a first rotation speed $R_1$, even when the representation of the torque Tq has reached above the first torque threshold $Tq_1$.

At time $t_2$ the torque Tq has reached below a second torque threshold $Tq_2$, which is lower than the first torque threshold $Tq_2$. This is noted by the actuator controller 4 from a feedback signal that reveals that the representation of the torque Tq has reached below this second torque threshold $Tq_2$. At time $t_2$ the actuator controller 4 will therefore return to control the actuator 10 in accordance with the first mode, where it controls the moving speed v at which the actuator 10 moves the rock drilling machine 3. Specifically, the actuator controller 4 will control the actuator 10 to provide a moving speed v corresponding to a first moving speed $v_1$. Hence, in the first mode the rock drilling machine 3 shall be moved in a constant moving speed v corresponding to a first moving speed $v_1$. In the first mode the actuator controller 4 controls a flow of hydraulic fluid delivered to the actuator 10, and in the second mode it controls the pressure of the hydraulic fluid delivered to the actuator 10.

The rock drilling machine 3 may be a hydraulic rock drilling machine, wherein the representation of the torque Tq generated by the rotation motor 9 may be determined from a pressure delivered to the rotation motor 9 to drive the rotation thereof.

As an alternative, the rock drilling machine may be an electric rock drilling machine, wherein the representation of the torque Tq generated by the rotation motor 9 is determined from a current delivered to the rotation motor 9 to drive the rotation thereof. In such an embodiment, the actuator controller 4 may be a control unit configured to control the electric power to an electric motor 7 arranged to move the rock drilling machine 3.

Figure 6:
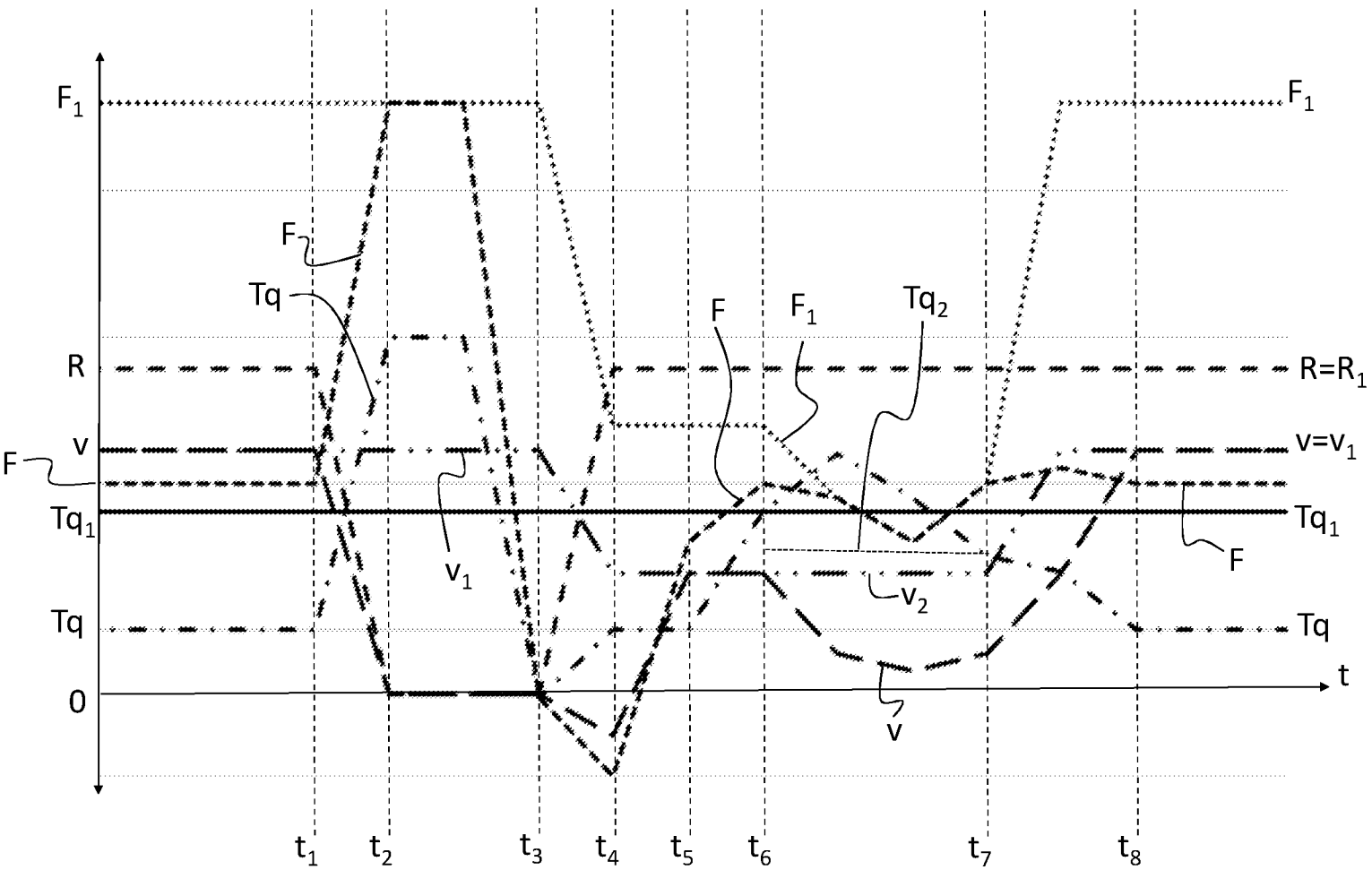
FIG. 6 is a schematic diagram of the progress of an arrangement according to an alternative aspect of the invention over time.

In FIG. 6, a very schematic representation of a second operation of extracting a drill string from a drilled bore is shown, which second operation is controlled in accordance with the inventive arrangement.

In the first part of the representation, prior to a represented time $t_1$ there are no obstacles present and the drill string may be moved backwards, i.e. opposite the drilling direction, at a constant moving speed v which corresponds to a desired first moving speed $v_1$. Also, the rotation speed R may be kept at a constant rotation speed corresponding to a desired, first rotation speed $R_1$. During this phase, which corresponds to the first mode, both the force F provided by the actuator 10 and the torque Tq provided by the drilling machine 3 may be held at a fairly constant and a fairly low level.

At time $t_1$ the drill string encounters an obstacle that hinders the moving and/or the rotation of the drill string. Hence, at this point both the force F provided by the actuator 10 and the torque Tq provided by the drilling machine 3 need to be increased to keep the moving speed v at the first moving speed $v_1$ and the rotation speed R at the first rotation speed $R_1$. In the illustrated scenario the actuator controller 4 does not react fast enough, such that when the torque Tq exceeds the first torque threshold $Tq_1$ the actuator controller 4 does not have time to limit the force F provided by the actuator 10. As a consequence, the result will be as in the prior art, i.e. that drill string will get jammed. At time $t_2$ the drill string is jammed, and both the moving speed v and the rotation speed R are nil.

At the time $t_3$ the retraction operation is restarted "backwards", i.e. in the normal drilling direction to relieve the drill string from its jammed position. Hence, from the time $t_3$ a negative force is applied to the actuator such that the jammed drill string will be pushed further into the drill hole with a negative moving speed v, and at time $t_4$ the negative force is reversed into a force F adapted to once again extract the drill string from the drill hole. At this point the rotation speed R has already reached a desired first rotation speed $R_1$.

A difference in the operation in this stage is that the desired moving speed is lowered to a second moving speed $v_2$. Hence, instead of restarting the operation in the second mode, the operation is restarted in the first mode, but at a second moving speed $v_2$, which is lower than the first moving speed $v_1$. The second moving speed $v_2$ is attained at time $t_5$, and from time $t_5$ to time $t_6$ the moving speed v is maintained at second moving speed $v_2$.

As the drill string re-enters the area in which the obstacle that caused the jamming is located the resistance will increase and as a consequence the force F provided by the actuator 10 and the torque Tq provided by the drilling machine 3 need to be increased to keep the moving speed v at the second moving speed $v_2$ and the rotation speed R at the first rotation speed $R_1$. At time is the torque Tq provided by the drilling machine 3 reaches above the first torque threshold $Tq_1$, which triggers the actuator controller 4 to control the actuator 10 in accordance with the second mode, wherein the force F provided by the actuator 10 will be limited to a first force threshold $F_1$, which is lowered in response to the increased Tq provided by the drilling machine 3. As a consequence, from the time is the moving speed v at which the actuator moves the drilling machine 3 and the drill string 6 will be allowed to pass below the second moving speed $v_2$.

Hence, the second moving speed $v_2$, which is set at the re-start in response to the jamming, will allow the actuator controller 4 to control the actuator 10 to react in time to occurring obstacles. Further, the rapid switch from the first mode to the second mode, which is helped by the lowered second moving speed $v_2$, makes it possible to ride through the obstacles within the bore hole without once again jamming the drill string within the drill hole.

It should be noted that a restart in the second mode, could risk to lead to an uncontrolled increase of the moving speed v at which the actuator moves the drilling machine 3 and the drill string 6, which may cause problems if and when the drill string 6 enters a troublesome area because it may lead to a heavy or at least uncontrolled impact which risk the to harm various parts of the drill equipment. Therefore, in view of the evident risks of repeated jamming due to the re-entry to an area with known obstacles, the moving speed v is instead controlled to the second moving speed $v_2$, which is lower than the first moving speed $v_1$.

At time $t_7$ the Tq provided by the drilling machine 3 reaches below a second torque threshold $Tq_2$, which triggers the actuator controller 4 to control the actuator 10 in accordance with the first mode, wherein the actuator 10 once again will be speed controlled, i.e. controlled to move the drilling machine at a specific moving speed v which in this case should correspond to the first moving speed $v_1$. As a more fail-safe alternative the operation could instead be continued in accordance with the first mode but at a specific moving speed v corresponding to the lower, second moving speed $v_2$. This is an operational choice that an operator may decide, either at an occurring incident and/or as part of a set of preferred pre-set operational parameters.

Also, the moving speed v may be pre-set at a specific moving speed $v_n$ based on various operational parameters such as the type of drill crown used, hardness of the rock in which the drill hole is drilled and so on.

At time $t_8$ the Tq provided by the drilling machine 3 has reached a low "steady-state" level and both the rotation speed R and the moving speed v are at preferred levels corresponding to a first rotation speed $R_1$ and a first moving speed $v_1$. This steady-state will be maintained as long as the actuator controller 4 does not receive feedback indicating that an obstacle has been encountered. From time is the operation will be continued in accordance with the first mode for as long as no new obstacles occur.

Figure 7:
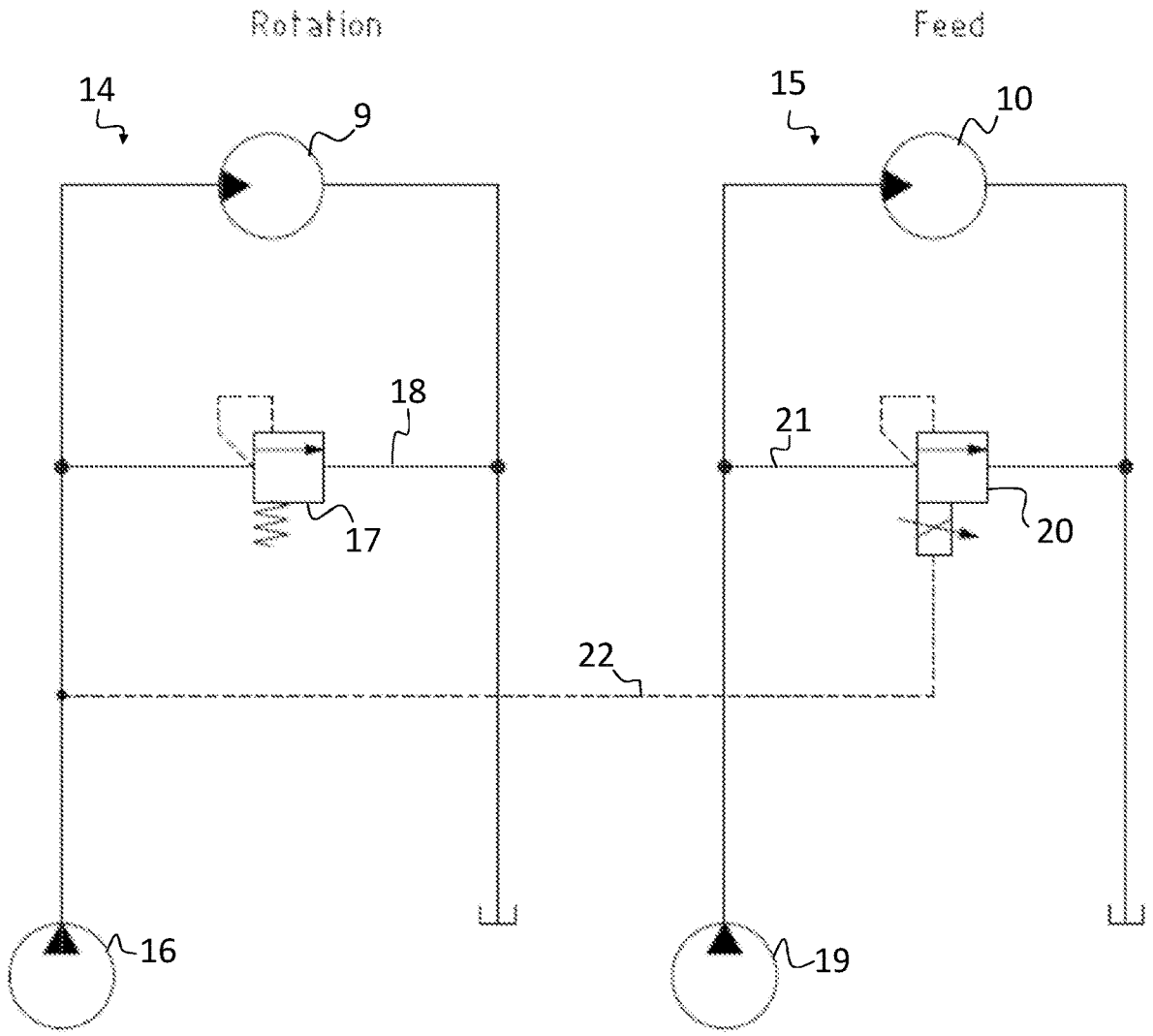
FIG. 7 is a schematic scheme of an arrangement according to a specific embodiment of the invention.

In FIG. 7, a very schematic representation of hydraulic scheme in accordance with an embodiment of the invention is shown.

In the shown embodiment the arrangement includes a first conduit 14 for the rotation motor 9 and a second conduit 15 for the actuator 10, which is separate from the first conduit 14. In the first conduit 14 a first pump 16 is arranged to provide a flow to drive the rotation motor 9. The first pump 16 may be arranged to provide a flow to the rotation motor 9 up to certain pressure threshold. This may be achieved in that a first spring biased bypass valve 17 is arranged to open a bypass line 18 past the rotation motor 9 when the pressure in the first conduit exceeds a specific pressure threshold corresponding to a first torque threshold $Tq_1$.

In the second conduit 15 a second pump 19 is arranged to provide a hydraulic flow to drive the actuator 10. The second pump 19 may be arranged to provide a flow to the actuator up to a certain pressure threshold. This may be achieved in that a second spring biased bypass valve 20 is arranged to open a bypass line 21 past the actuator 10 when the pressure in the second conduit 15 exceeds a specific pressure threshold corresponding to a first force threshold $F_1$.

A pilot line 22 may be arranged from the first conduit 14 to the second spring biased valve of the second conduit 15 to control the second spring biased valve 20 based on the pressure in the first conduit line 14. Specifically, the pilot signal delivered in the pilot line 22 will act to decrease the pressure threshold needed to open the second spring biased bypass valve 20. Hence, the second spring biased bypass valve 20 opens in response to a lower rotation pressure and the flow through the actuator 10 will decrease such that the feed pressure through the actuator 10 will decrease. Also, as a consequence, the moving speed v will decrease. Hence, the pilot line 22 functions to lower the first threshold force $F_1$ which the limits the force provided by the actuator 10.

Above, the invention has been described with reference to specific embodiments. The invention is however not limited to these embodiments. It is obvious to a person skilled in the art that other embodiments are possible within the scope of the following claims.

The invention claimed is:

1. An arrangement for controlling a rock drilling machine during an extraction of a drill string from a drilled bore, the rock drilling machine being movably arranged on a feeder, the arrangement comprising:

an actuator arranged to move the rock drilling machine in a direction opposed to a drilling direction along the feeder, a rotation motor arranged to rotate the drill string, and an actuator controller arranged to control the actuator during the extraction of the drill string from a drilled bore, the actuator controller being arranged to control the actuator according to a first and a second mode in dependence of at least one operational parameter from a set of parameters including: a representation of a torque generated by the rotation motor to rotate the drill string, a representation of a rotation speed of the drill string provided by the rotation motor, a representation of a force provided by the actuator to move the rock drilling machine in the direction opposed to the drilling direction, and a representation of a moving speed of the rock drilling machine provided by the actuator, wherein the actuator controller, in the first mode, is arranged to control a moving speed at which the actuator moves the rock drilling machine in the direction opposed to the drilling direction, and wherein the actuator controller, in the second mode, is arranged to control a force provided by the actuator to move the rock drilling machine in the direction opposed to the drilling direction.

2. The arrangement according to claim 1, wherein the actuator controller is configured to switch control of the actuator from the first mode to the second mode in response to that at least one operational parameter from the set of parameters exceeds or falls below a first threshold.

3. The arrangement according to claim 1, wherein the actuator controller is configured to switch control of the actuator from the first mode to the second mode in response to that the representation of torque generated by the rotation motor exceeds a first torque threshold.

4. The arrangement according to claim 1, wherein the actuator controller is configured to switch control of the actuator from the first mode to the second mode in response to that the representation of torque generated by the rotation motor increases at a rate that exceeds a first threshold rate.

5. The arrangement according to claim 1, wherein a rotation controller is arranged control the rotation motor of the drilling machine to maintain the rotation speed at or above a first rotation speed in the second mode.

6. The arrangement according to claim 5, wherein the rock drilling machine is a hydraulic rock drilling machine and wherein the representation of the torque generated by the rotation motor is determined from a representation of a rotation pressure of a hydraulic fluid delivered to the rotation motor to drive the rotation thereof.

7. The arrangement according to claim 1, wherein the actuator controller, in the first mode, is arranged control the actuator to a moving speed corresponding to a first moving speed.

8. The arrangement according to claim 7, wherein the actuator controller, in a restart of the extraction operation after a confirmed jamming of the drill string, is arranged to control the actuator to a moving speed corresponding to a second moving speed, which is lower than the first moving speed.

9. The arrangement according to claim 1, wherein the actuator controller is arranged to switch control of the actuator from the second mode to the first mode when the representation of the torque provided by the rotation motor to generate a rotation speed of the drill string corresponding to a first rotation speed, reaches below a second torque threshold.

10. The arrangement according to claim 1, wherein the actuator comprises a hydraulic motor and wherein the actuator controller is a control device configured to control the provision of hydraulic fluid to the actuator and wherein the actuator controller in the first mode controls a flow of hydraulic fluid delivered to the actuator, and in the second mode controls a pressure of the hydraulic fluid delivered to the actuator.

11. A drill rig, comprising:

a rock drilling machine; and an arrangement for controlling movement of the rock drilling machine during an extraction of a drill string connected to the rock drilling machine from a drilled bore hole, wherein the arrangement comprising:

an actuator arranged to move the rock drilling machine in a direction opposed to a drilling direction along the feeder;

a rotation motor arranged to rotate the drill string; and an actuator controller arranged to control the actuator during the extraction of the drill string from a drilled bore, the actuator controller being arranged to control the actuator according to a first and a second mode in dependence of at least one operational parameter from a set of parameters including: a representation of a torque generated by the rotation motor to rotate the drill string, a representation of a rotation speed of the drill string provided by the rotation motor, a representation of a force provided by the actuator to move the rock drilling machine in the direction opposed to the drilling direction, and a representation of a moving speed of the rock drilling machine provided by the actuator, wherein the actuator controller, in the first mode, is arranged to control a moving speed at which the actuator moves the rock drilling machine in the direction opposed to the drilling direction, and wherein the actuator controller, in the second mode, is arranged to control a force provided by the actuator to move the rock drilling machine in the direction opposed to the drilling direction.

* * * * *